US007581596B2

(12) United States Patent
Reimert et al.

(10) Patent No.: US 7,581,596 B2
(45) Date of Patent: Sep. 1, 2009

(54) DOWNHOLE TOOL WITH C-RING CLOSURE SEAT AND METHOD

(75) Inventors: Larry E. Reimert, Houston, TX (US); James M. Walker, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 0 days.

(21) Appl. No.: 11/726,217

(22) Filed: Mar. 21, 2007

(65) Prior Publication Data

US 2007/0272420 A1 Nov. 29, 2007

Related U.S. Application Data

(60) Provisional application No. 60/785,653, filed on Mar. 24, 2006.

(51) Int. Cl.
*E21B 33/128* (2006.01)

(52) U.S. Cl. ..... 166/386; 166/318; 166/332.4; 166/373

(58) Field of Classification Search ..... 166/318, 166/332.4, 386, 373
See application file for complete search history.

(56) References Cited

U.S. PATENT DOCUMENTS 4,828,037 A 5/1989 Lindsey et al.
4,923,938 A 5/1990 Kao et al.
5,244,044 A 9/1993 Henderson
5,553,672 A 9/1996 Smith, Jr. et al.
5,960,879 A * 10/1999 Echols ..... 166/278
6,131,662 A * 10/2000 Ross ..... 166/369
6,575,238 B1 6/2003 Yokley
6,655,456 B1 12/2003 Yokley
6,666,276 B1 12/2003 Yokley et al.
6,681,860 B1 1/2004 Yokley et al.
6,712,152 B1 3/2004 Yokley et al.
6,722,428 B2 4/2004 Yokley
6,739,398 B1 5/2004 Yokley et al.
6,761,221 B1 7/2004 Yokley et al.
6,866,100 B2 3/2005 Gudmestad et al.

OTHER PUBLICATIONS

Product Report, Baker Oil Tools, Liner Hangers, 2 pgs, Aug. 1994.
US 4,926,939, 05/1990, Baugh (withdrawn)

* cited by examiner

*Primary Examiner*—Jennifer H Gay
*Assistant Examiner*—Robert E Fuller
(74) *Attorney, Agent, or Firm*—Browning Bushman P.C.

(57) ABSTRACT

A downhole tool 100 includes a closure seat 116, 176 for seating with a closure, such as a ball. Shear pins or other connectors temporarily limit axial movement of the closure seat which is initially housed within a restricted diameter portion of the central throughbore in the tool body. The closure seat may be lowered to engage a stop 108, 157, thereby positioning the seat within an enlarged diameter bore portion of the tool and allowing radial expansion of a closure seat to release the ball.

24 Claims, 14 Drawing Sheets

DOWNHOLE TOOL WITH C-RING CLOSURE SEAT AND METHOD

CROSS REFERENCE TO RELATED APPLICATIONS

This application claims priority from U.S. Patent Application Ser. No. 60/785,653, filed Mar. 24, 2006 for a DOWNHOLE TOOL WITH C-RING CLOSURE SEAT, which is incorporated herein in its entirety for all purposes.

FIELD OF THE INVENTION

The present invention relates to downhole tools adapted for receiving a ball or other closure member to provide for the increase in fluid pressure above the seated closure within the tool, thereby actuating components of the tool. More particularly, the present invention relates to a liner hanger assembly for hanging a liner in a well, and to a relatively simple and highly reliable closure seat which allows a ball to reliably pass by the seat after desired tool operations are complete.

BACKGROUND OF THE INVENTION

Various types of downhole tools are adapted for utilizing an increase in fluid pressure to actuate components of the tool. Packer setting tools, multilateral tools and liner hangers are plus exemplary of downhole tools which rely upon an increase in fluid pressure above a seated closure to actuate the tool.

Some tools utilize collet fingers as a ball seat, so that the collet fingers are shifted from the contracted position to an expanded position to allow the ball to drop through the expanded ball seat. Various problems with this design may occur when the collet fingers fail to properly seal and do not allow for pressure to build up so that the collet fingers can move downward and let the ball drop through the seat. Another problem with this type of expandable ball seat is that wellbore fluids pass by the collet fingers, thereby eroding the fingers and tending to cause the ball seat to fail. A ball seat design with collet fingers may also fail to seal properly and not allow for the pressure to build up so that the collets release to pass the ball through the seat. U.S. Pat. Nos. 4,828,037, 4,923,938, and 5,244,044 are examples of patents disclosing expandable ball seats.

U.S. Pat. No. 5,553,672 discloses another design for setting a ball on a seat. This design relies upon a rotating ball valve, so that in one position there is a small hole in the valve which acts as the ball seat. A small ball lands on the small hole, and pressure is applied to the tool. Pressure is applied to rotate the ball, allowing the small ball to drop. This design is complicated with many parts and components that may cause failure.

U.S. Pat. No. 6,681,860 discloses a yieldable ball seat. Quality control for the expandable area may be difficult, and the expandable ball seat may not yield when intended. Material control is also important since the expandable areas expand at a certain pressures. Expandable ball seats thus do not always reliably release the ball at a preselected pressure. In some situations, pressure used to release the ball from the upper seat may generate a full force sufficient to pass the ball through the lower seat, which then makes it impractical to further operate the tool. High pressure applied to the ball releasing system may also damage the tool or damage the skin of the downhole formation.

U.S. Pat. No. 6,866,100 discloses a mechanically expanding ball seat which utilizes pipe manipulation of a drill string after the liner hanger is set to open the seat and release the ball. This system releases the ball mechanically rather than using fluid pressure. The design as disclosed in this patent is complicated, and one has to equalize the pressure across the ball seat before mechanically manipulating the drill string to release the ball.

The disadvantages of the prior art are overcome by the present invention and an improved downhole tool with a C-ring closure seat for receiving a ball or other closure member is hereinafter disclosed.

SUMMARY OF THE INVENTION

According to one embodiment, a liner hanger assembly includes a tool mandrel supported from a running string, a slip assembly for setting slips to engage the casing and support the liner hanger from the casing, and a releasing mechanism for releasing the set liner hanger from portions of the tool returned to the surface. The liner hanger assembly further comprises an expandable C-ring seat positioned about a central flow path in the tool for seating the closure member. The C-ring is initially retained in an upper position by a radially outward retainer. A seal is provided above the C-ring for sealing with the ball or other closure member when seated on the C-ring. A release member, such as a shear pin, releases the C-ring for axial movement in response to a predetermined fluid pressure above the ball. An enlarged C-ring receiving cavity is provided for receiving an expanded C-ring when released by the releasing member, thereby releasing the closure member from the C-ring. The desired liner hanger operations may be performed with increasing fluid pressure controlled by the operator at the surface. The ball or other closure member may be released upon completion of the desired tool operations. In another embodiment, the C-ring seat and the releasing member may be provided in other downhole tools, including a production packer, a downhole setting tool, or a multilateral tool.

In another embodiment, the liner hanger assembly as discussed above is provided with an expandable C-ring and a seal for sealing with the closure member when positioned on the C-ring. A shear pin release member need not be provided, and instead the operator may selectively pick up the work string, thereby lifting a sleeve-shaped retainer which holds in pins which serve as stops to hold the C-ring in an axially intermediate position. Upward movement of the retainer thus allows the C-ring to expand to its expanded position within an enlarged lower diameter cavity, thereby releasing the ball. A similar assembly may be used in other downhole tools to activate tool components in response to a varying pressure level within the tool, including one or more production packers, a downhole setting tool, or a multilateral tool.

These and further features and advantages of the present invention will become apparent from the following detailed description, wherein reference is made to the figures in the accompanying drawings.

DESCRIPTION OF THE ILLUSTRATED EMBODIMENTS

Figure 1A:
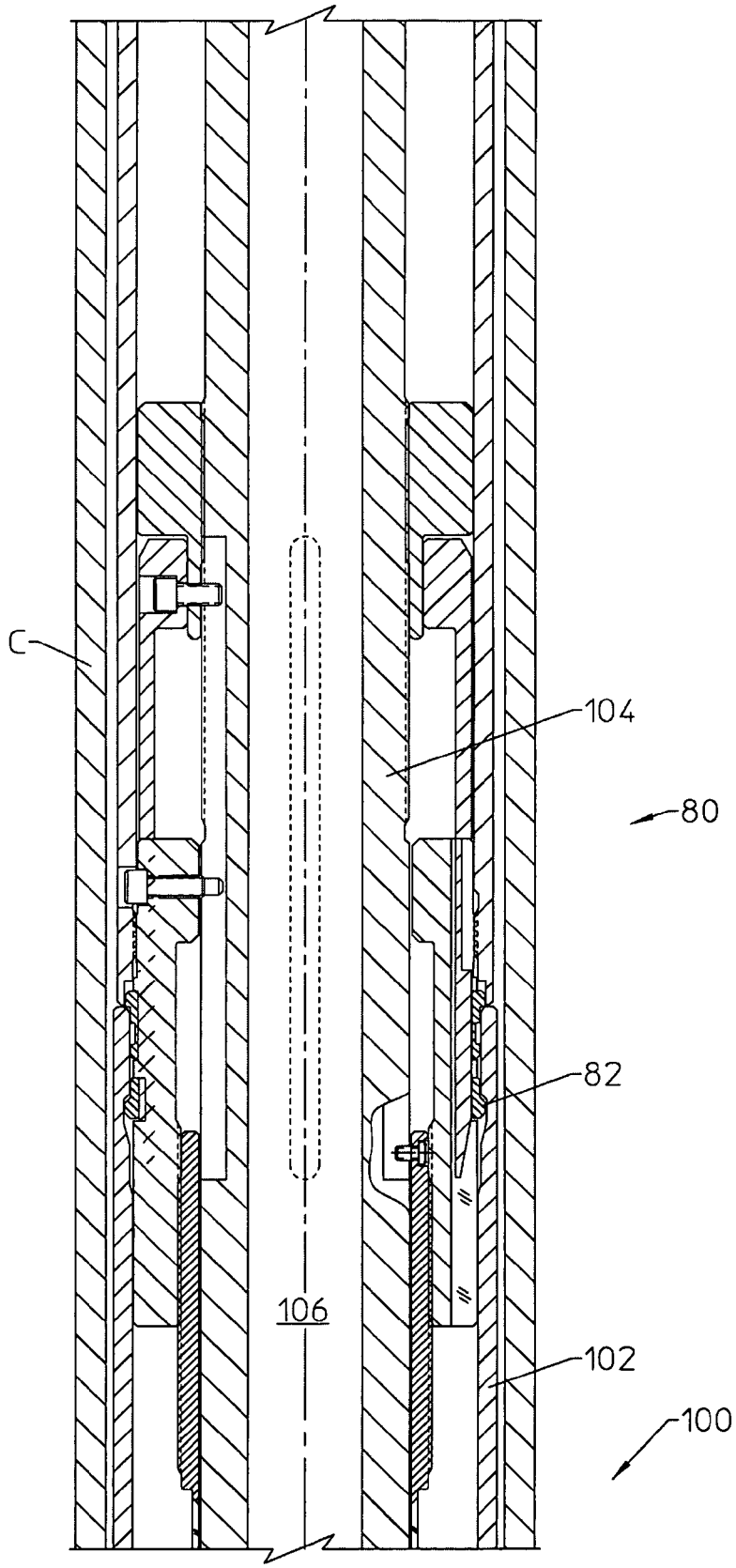
FIGS. 1A through 1G illustrate sequentially the primary components of a suitable liner hanger running tool.
Figure 1B:
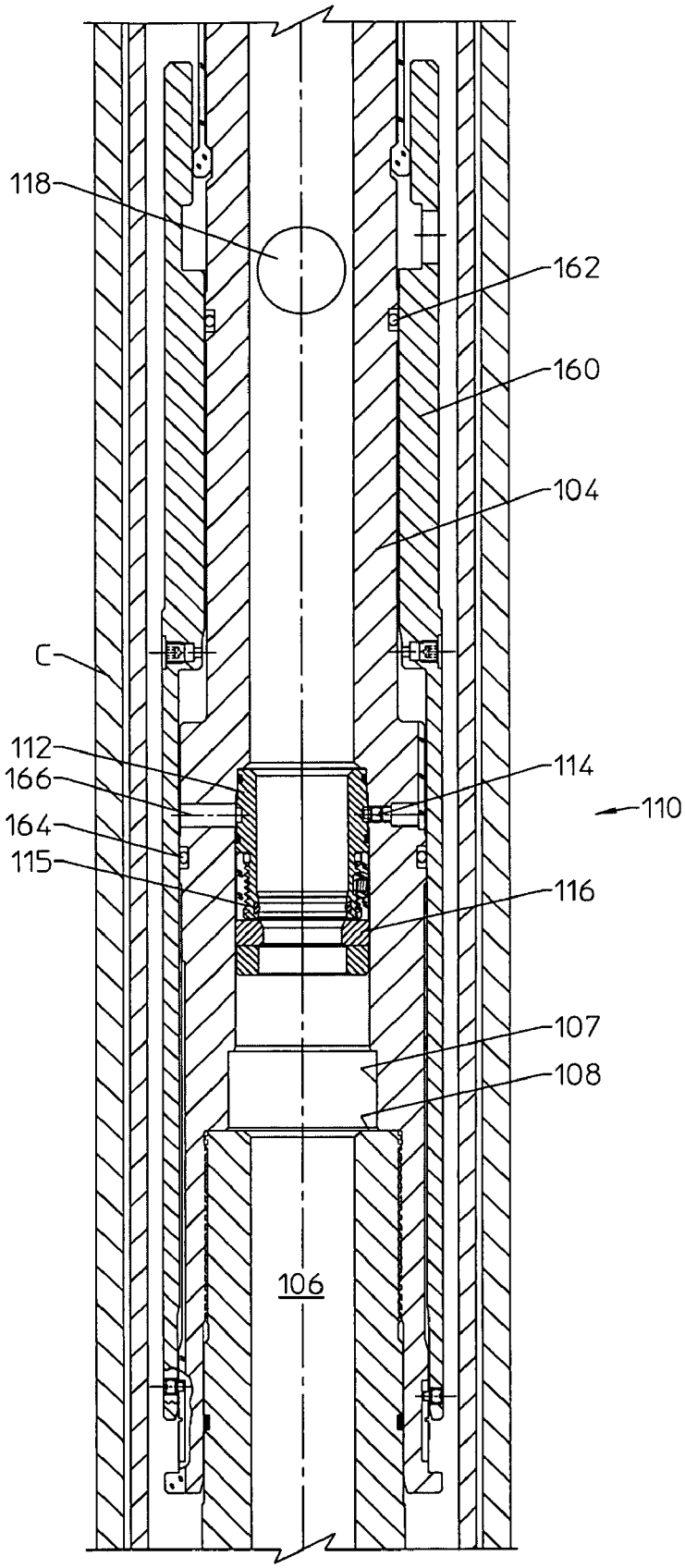
Figure 1C:
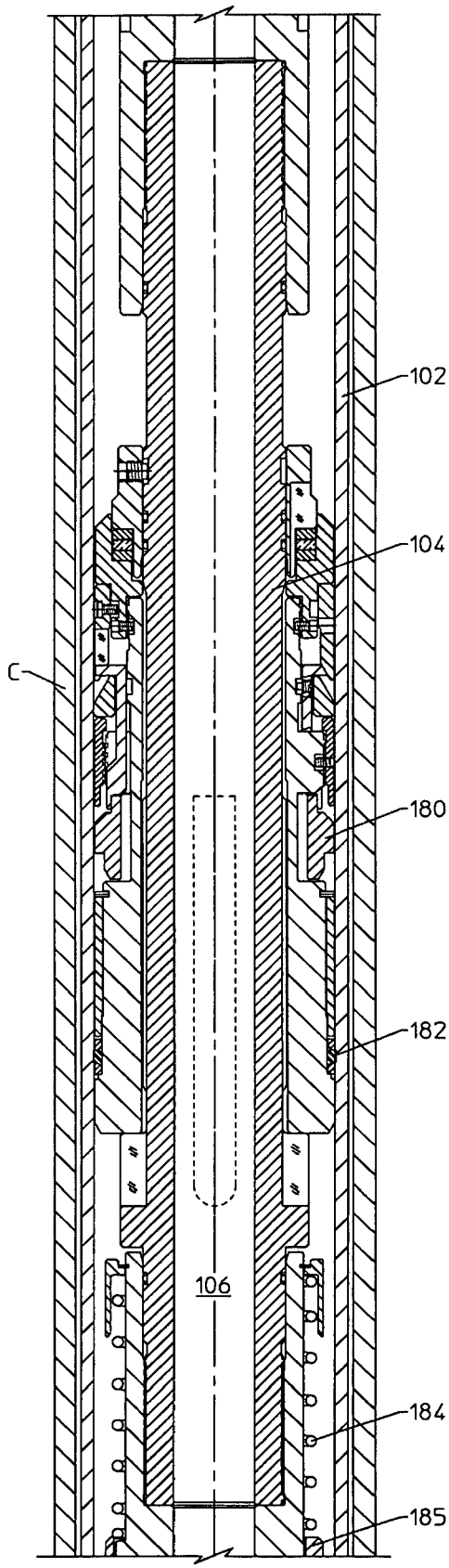
Figure 1D:
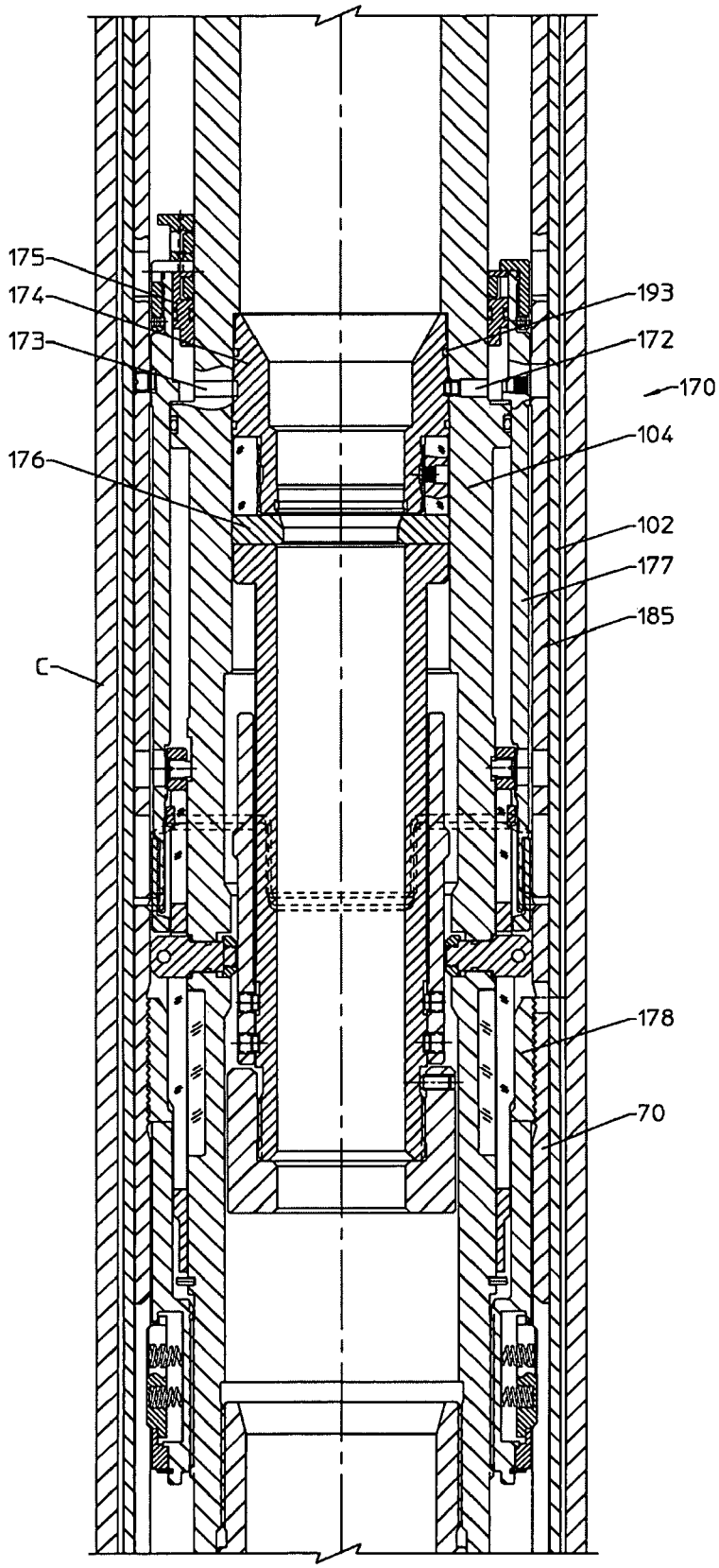
Figure 1E:
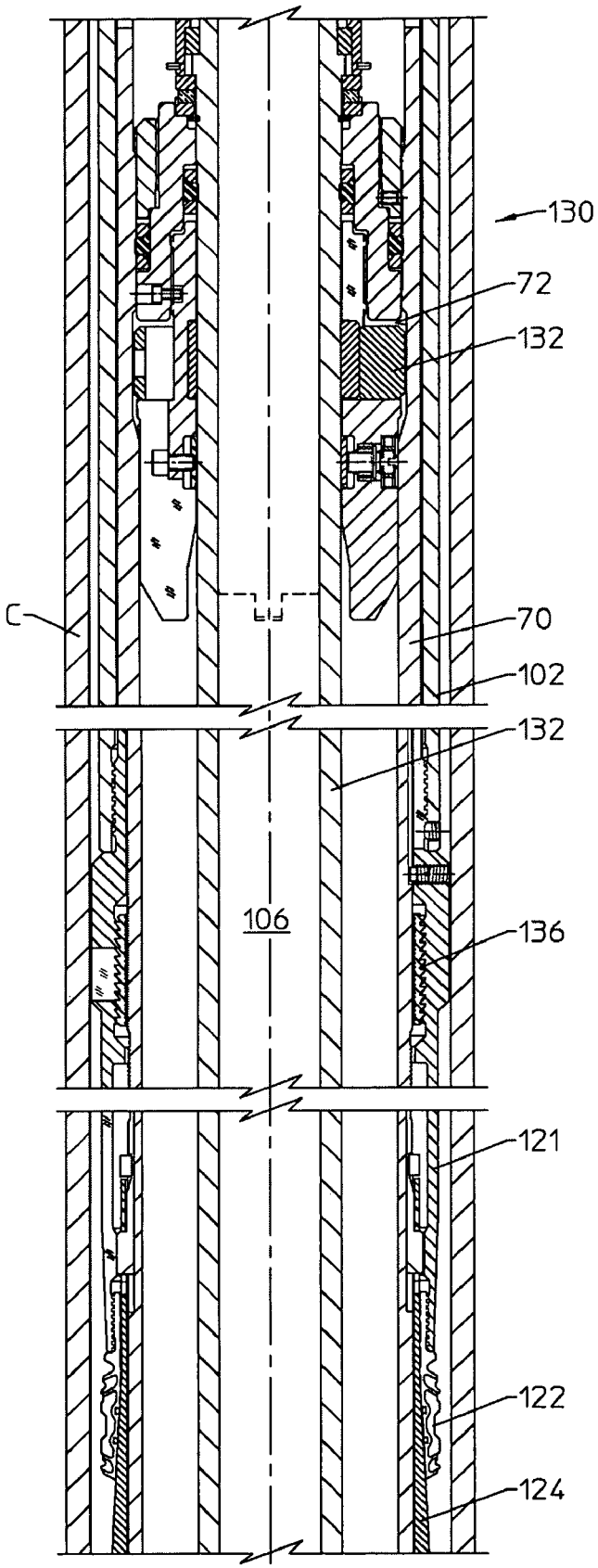
Figure 1F:
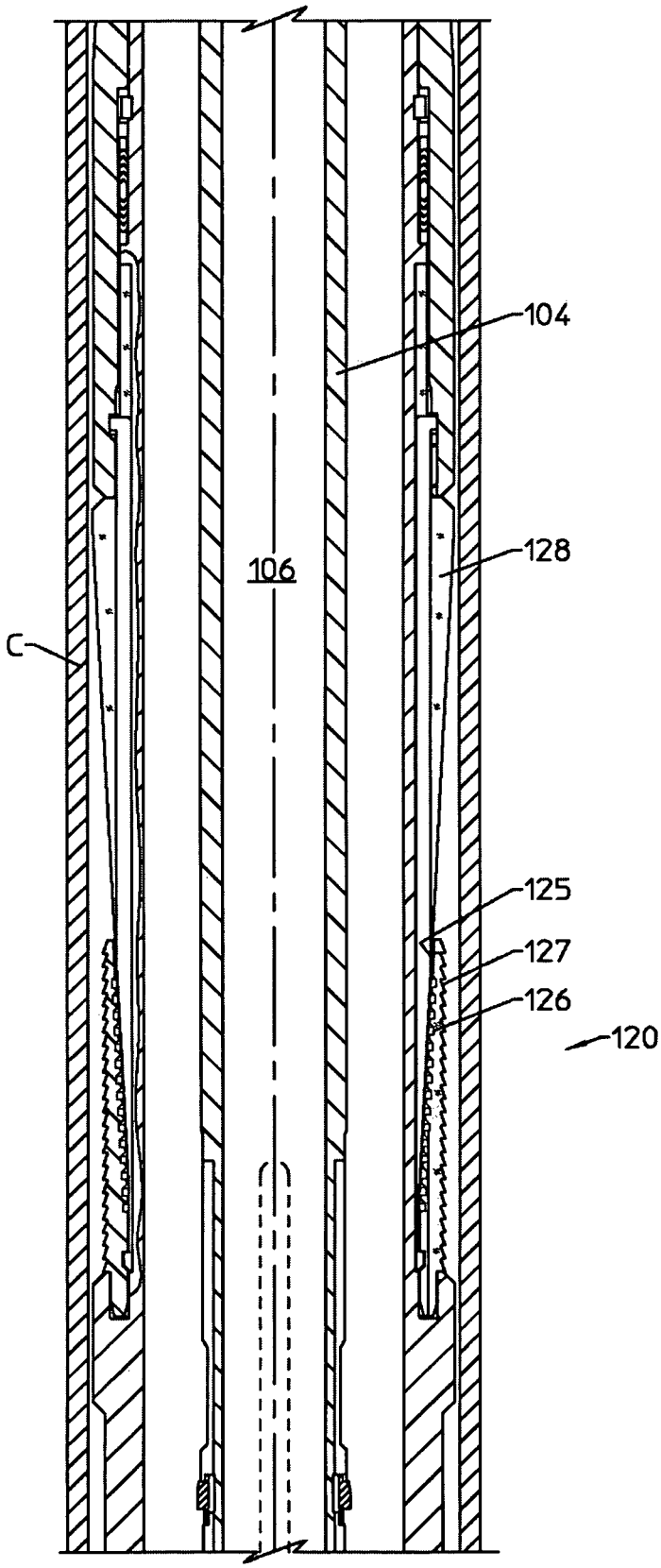
Figure 1G:
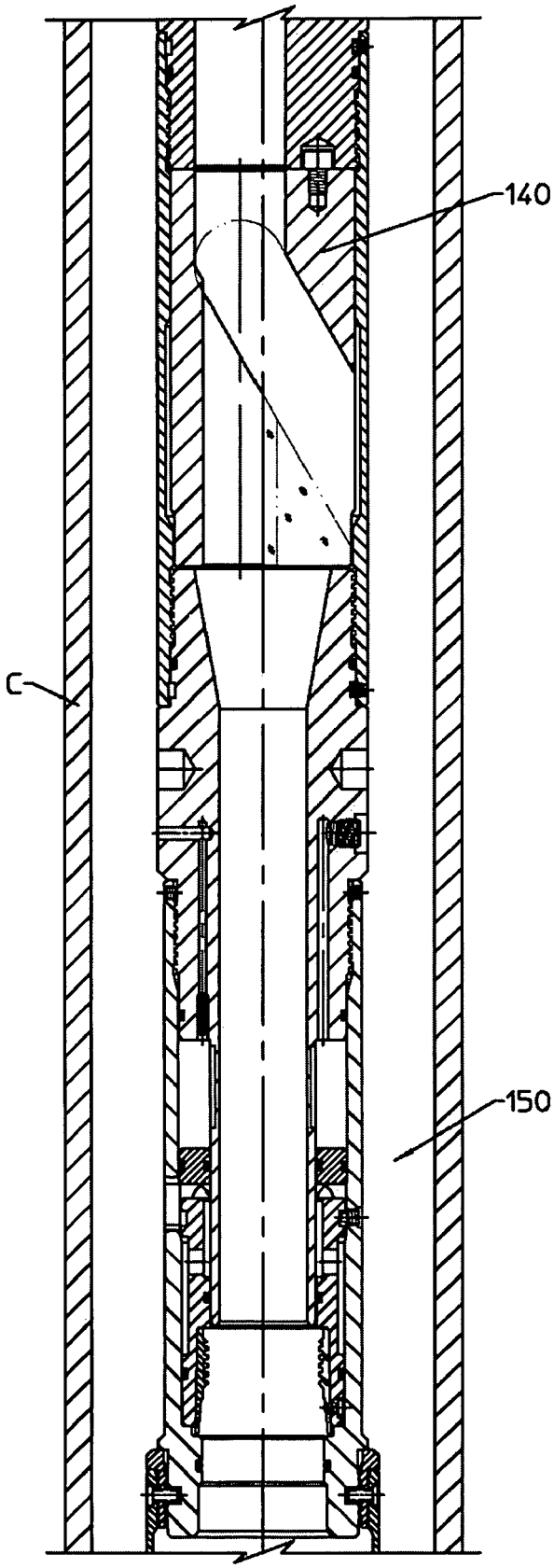

FIG. 1, which consists of FIGS. 1A-1G, illustrates one embodiment of a liner hanger tool 100 with two C-ring seat subassemblies each for seating with a closure member in a liner hanger application. An upper C-ring seat subassembly 110 is shown in FIG. 1B, and a lower C-ring seat subassembly 170 is shown in FIG. 1D. Other than components associated with seating and releasing the closure member, the primary components of the liner hanger running tool 100 as shown in FIG. 1 include a running tool tieback locking mechanism 80 (FIG. 1A), a slip release assembly operatively responsive to the upper C-ring seat assembly 110, packer setting lugs 180 (FIG. 1C), a liner hanger release assembly operatively responsive to the lower C-ring seat assembly (FIG. 1D), a cementing bushing 130 (FIG. 1E), and a ball diverter 140 and plug release assembly 150 (FIG. 1G). FIG. 1E illustrates the packer 122 and FIG. 1F illustrates the slip assembly 120, which are not part of the running tool retrieved to the surface, and remain downhole with the set liner. The C-ring seat subassemblies disclosed more fully below are used in the liner hanger running tool to activate the slip assembly using an upper C-ring ball seat, and to separately activate a liner hanger releasing assembly using a lower C-ring ball seat. The function served by each C-ring ball seat will thus vary with the tool functions being activated, and the pressure levels and sequencing of the tool.

To hang off a liner, the running tool 100 is initially be attached to the lower end of a work string and releasably connected to the liner hanger, from which the liner is suspended for lowering into the bore hole beneath the previously set casing or liner C.

A tieback receptacle 102 as shown in FIG. 1A is supported about the running tool 100. The upper end of the tieback receptacle 102, upon removal of the running tool, provides for a casing tieback (not shown) to subsequently extend from its upper end to the surface. The tool 100 includes a central mandrel 104, which may comprise multiple connected sections, with a central bore 106 in the mandrel. The lower end of the tieback receptacle 102 is connected to the packer element pusher sleeve 121, as shown in FIG. 1E, whose function will be described in connection with the setting of the packer element 122 about an upper cone 124, as well as setting of the slips 126 about a lower cone 128 (see FIG. 1F).

The running tool 100 also includes a cementing bushing 130 (see FIG. 1E), and a ball diverter 140 (see FIG. 1G) at the lower end of the running tool. The cementing bushing 130 provides a retrievable and re-stabbable seal between the running tool 100 and the liner hanger assembly for fluid circulation purposes. By incorporating an axially movable slick joint 132 (which may functionally be an extension of the mandrel 104), the running tool may be axially moved relative to components to remain in the well without breaking the seal provided by the cementing bushing 130.

FIG. 1A also illustrates a tieback locking mechanism 80. A split ring 82 locks the tieback 102 to the running tool mandrel 104. The tieback locking mechanism prevents premature actuation of the tool as it is run in the well. The locking mechanism 80 unlocks the tieback 102 to allow the slips 126 to be set. More particularly the slips 126 are kept from prematurely setting as the tool 100 is run into the wellbore by the tieback locking mechanism 80, which grippingly engages the upper end of the tieback 102 to prevent its upward movement prior to setting the slips.

The tool actuator subassembly 110 as shown in FIG. 1B is used to release the liner hanger slips for setting, and includes a sleeve 112 disposed within and axially movable relative to the running tool mandrel 104. The sleeve 112 is held in its upper position by shear pins 114. A C-ring ball seat 116 is supported on the sleeve 112. A seal 115 is provided for sealing with the seated ball. A ball 118 may thus be dropped from the surface into the running tool bore 106 and onto the seat 116. An increase in fluid pressure within the mandrel 104 above the seated ball will shear the pins 114 and lower the ball seat 116 and sleeve 112 to a lower position in the bore of the running tool, e.g., against the stop shoulder 108. Once the subassembly is lowered, fluid pressure may pass through ports 166 to stroke a piston and thereby release the slips for setting.

Piston sleeve 160 is disposed about and is axially movable relative to mandrel 104. An upper sealing ring 162 is disposed about a smaller O.D. of the running tool mandrel than is the lower sealing ring 164 to form an annular pressure chamber between them for lifting the tieback receptacle 102 from the position shown in FIG. 1B to an upper position for setting the slips or slip segments 126. Ports 166 formed in the running tool mandrel 104 connect the running tool bore with the surrounding pressure chamber once the seat 116 and sleeve 112 are lowered. An increase in pressure through the ports 166 will raise the piston sleeve 160. Upward movement of the piston sleeve 160 causes its upper end to raise the tieback receptacle 102, and also raise the slips 126.

The slip assembly 120 shown in FIG. 1F is made up of arcuate slip segments 126 received within circumferentially spaced recesses in slip body sleeve about the lower end of the liner hanger and adjacent the lower cone 128. Each slip segment 126 includes a relatively long tapered arcuate slip having teeth 127 on its outer side and an arcuate cone surface 125 mounted on its inner side for sliding engagement with lower cone 128. When three circumferentially spaced slip segments are used, each of three recesses may include a slot in each side. Alternatively, a one piece C-slip may be used to replace the slip segments. The teeth 127 are adapted to bite into the casing C as the liner weight is applied to the slip. The slips 126 are thus movable vertically between a lower retracted position, wherein their outer teeth 127 are spaced from the casing C, and an upper position, wherein the slips 126 have moved vertically over the cone 128 and into engagement with the casing C.

FIGS. 1E and 1F show the relationship of both the packer element 122 and the circumferentially spaced slips 126 about the upper 124 and lower 128 cones, respectively. The annular packer element 122 is disposed about a downwardly-enlarged upper cone 124 beneath the pusher sleeve 121. The packer element 122 is originally of a circumference in which its O.D. is reduced and thus spaced from the casing C. However, the packer element 122 is expandable as it is pushed downwardly over the cone 124 to seal against the casing.

FIG. 1E also illustrates the cementing bushing 130. The cementing bushing provides a retrievable and re-stabbable seal between the running tool and the liner hanger for fluid circulation purposes. The cementing bushing 130 cooperates with the slick joint 132 to allow axial movement without breaking the seal provided by the cementing bushing. The mandrel 104 of the released running tool can be used to raise the cementing bushing 130 to cause the lugs 132 to move in and unlock from the liner hanger. The liner hanger 70 is shown with an annular groove 72 for receiving the lugs 132. The cementing bushing 130 seals between a radially outward liner running adapter of the liner hanger and a radially inward running tool mandrel.

Ratchet ring 136 is also shown in FIG. 1E. This ratchet ring allows the packer element 122 to be pushed downward over the upper cone 124, then locks the packer element in its set position.

The packer element 122 may be set by using spring-biased pusher C-ring 180 (see FIG. 1C) which, when moved upwardly out of the tieback receptacle 102, will be forced to an expanded position to engage the top of the tieback receptacle. The released running tool may be picked up until the packer setting subassembly is removed from the top of a tieback receptacle, so that the pusher C-ring 180 is raised to a position above the top of the tieback receptacle and expanded outward. When the packer setting assembly is in this expanded position, weight may be slacked off by engaging the pusher C-ring 180 to the top of the tieback 102, which then causes the packer element 122 to begin its downward sealing sequence. When weight is set down, the expanded pusher C-ring 180 transmits this downward force through the tieback receptacle 102 to the pusher sleeve 121, and then the packer element 122 (see FIG. 1E). This weight also activates a sealing ring 182 (see FIG. 1C) between the packer setting assembly and the tieback receptacle to aid in setting the packer element with annulus pressure assist. The lower portion of FIG. 1C illustrates the upper portion of a clutch 185 splined to the OD of the running tool mandrel 104 to transmit torque while allowing axial movement between the clutch and the mandrel. The central portion of the clutch 185 is shown in FIG. 1D, and may move in response to biasing spring 184.

The first time the packer setting assembly is moved out of the polished bore receptacle running tool, a trip ring may snap to a radially outward position. When the packer setting assembly is subsequently reinserted into the polished bore receptacle, the trip ring will engage the top of the polished bore receptacle, and the packer setting C-ring is positioned within the polished bore receptacle. When set down force is applied, and the trip ring will move radially inward due to camming action. The entire packer setting assembly may thus be lowered to bottom out on a lower portion of the running adapter prior to initiating the cementing operation. The next time the packer setting assembly is raised out of the polished bore receptacle, the radially outward biasing force of the C-ring will cause the C-ring to engage the top of the tieback. Further details regarding the packer seating assembly are disclosed in U.S. Pat. No. 6,739,398.

The packer element 122 may be of a construction as described in U.S. Pat. No. 4,757,860, comprising an inner metal body for sliding over the cone and annular flanges or ribs which extend outwardly from the body to engage the casing. Rings of resilient sealing material may be mounted between such ribs. The seal bodies may be formed of a material having substantial elasticity to span the annulus between the liner hanger and the casing C.

The C-ring seat subassembly 170 as shown in FIG. 1D may be disposed beneath the upper C-ring seat subassembly 110 shown in FIG. 1B. The lower C-ring seat subassembly 170 is secured within the running tool bore by shear pins 172. Sleeve 174 thus supports seat 176. The ball 118 when released from the upper seat will land onto the lower seat 176. Once the ball is seated, the predetermined pressure may be applied to shear pins 172 and move the ball seat 176 and the sleeve 174 downward to uncover the ports 173. Higher fluid pressure may then be applied to cause the piston sleeve 177 to move upward and thereby disengage the running tool from the set liner hanger. Assembly 170 releases the remainder of the tool to be retrieved to the surface from the set liner. Upon raising of the inner piston 177, the running tool may be raised from the set liner hanger, but prior to setting of the packer, thus releasing the ball and permitting circulation of cement downwardly through the tool and upwardly within the annulus between the tool and casing.

FIG. 1D also illustrates a hydrostatic balance piston 175 for balancing fluid pressure across the seal 193 to increase high reliability for the operation of sleeve 174. More particularly, piston 175 may be pumped upward at substantially atmospheric pressure prior to running the tool in the well. As the tool is lowered in the well and hydrostatic pressure increases, the increased pressure above the piston 173 will be balanced by a substantially identical pressure below piston 173, and thus is the pressure in the cavity between piston 173 and sleeve 174, resulting in some downward movement of piston 173 to equalize pressure. Seals 193 above and below port 173 are thus subjected to substantially the same fluid pressure on both sides of the seals, thereby enhancing operation of the sleeve 174.

FIG. 1D illustrates split ring 178 for gripping the liner hanger 70. The split ring may be moved radially to position so that it may contract radially inward, thereby releasing the running tool from the liner hanger.

FIG. 1G illustrates a lower portion of the tool, including a ball diverter 140 and a liner wiper plug release assembly 150. The assembly 150 replaces the need for shear screws to secure the liner wiper plug to the running tool. The plug holder shown in FIG. 1G is functionally similar to the plug release assembly disclosed in U.S. Pat. No. 6,712,152. Tool components and operations not detailed herein may be functionally similar to the components and operations discussed in U.S. Pat. No. 6,681,860.

After activating the lower C-ring seat subassembly 170, the operator may lift up the tool to pass the ball through seat 176. A drop in pressure will indicate that the ball has passed through the ball seat, allowing circulation through the running string to continue, and the ball to be pumped downwardly into the ball diverter. Fluids are then circulated through the tool awaiting cement displacement. Cement is then injected through the running tool, and pump down plug follows the cement and the liner wiper plug to form a barrier to the previously displaced cement and the displacement fluid.

Figure 2:
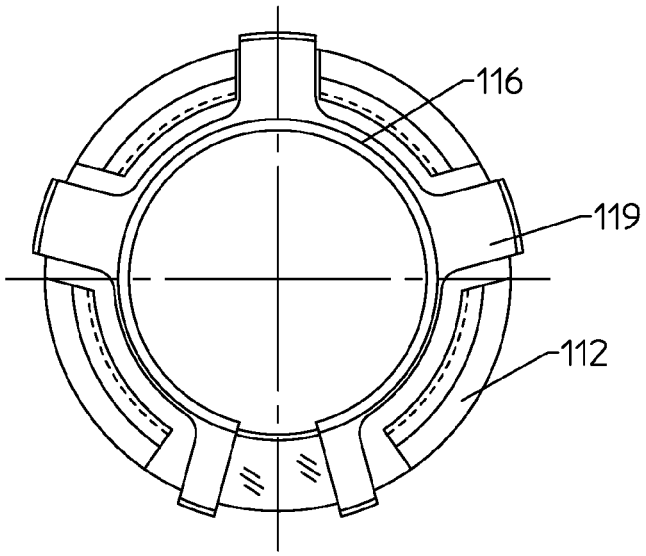
FIG. 2 illustrates in greater detail a top view of the C-ring seat subassembly shown in FIG. 1B.
Figure 3:
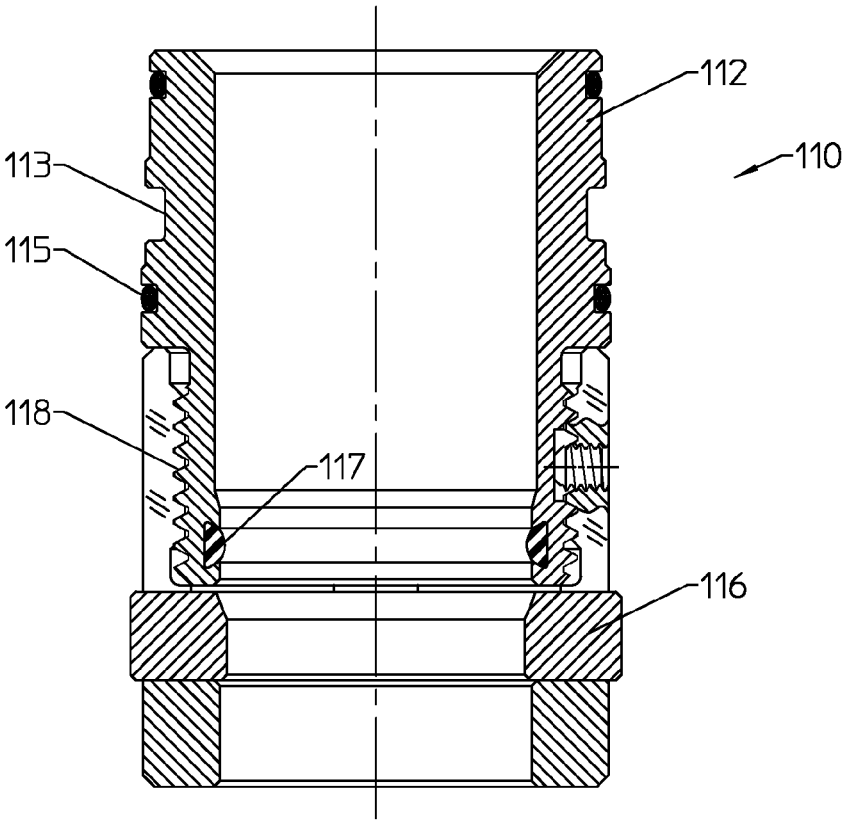
FIG. 3 is a cross-sectional enlarged view of the C-ring seat subassembly shown in FIG. 1B.

Referring now to FIG. 3, the upper C-ring seat subassembly which serves as a tool actuator for setting the slips is shown in greater detail. Upper sleeve portion 112 includes an annular slot or one or more circumferentially spaced slots 113 as shown in FIG. 3 each for receiving a respective shear pin 114, as shown in FIG. 1B. Upper sleeve portion 112 is threaded at 118 to lower body 111. One or more external seals 115 on the upper sleeve portion 112 are provided for sealing engagement with the interior wall of the mandrel 104. A seal 117 is provided on the interior of the upper sleeve portion 112 for sealing with the ball or other closure member when seated on the C-ring 116. A seal alternatively may be supported on the closure itself, or on another component. The body may be made in two parts, which are connected by threads 118. The upper sleeve portion 112 is not shown in FIG. 2, which is a top view of C-ring 116 and sleeve body 111.

Figure 4:
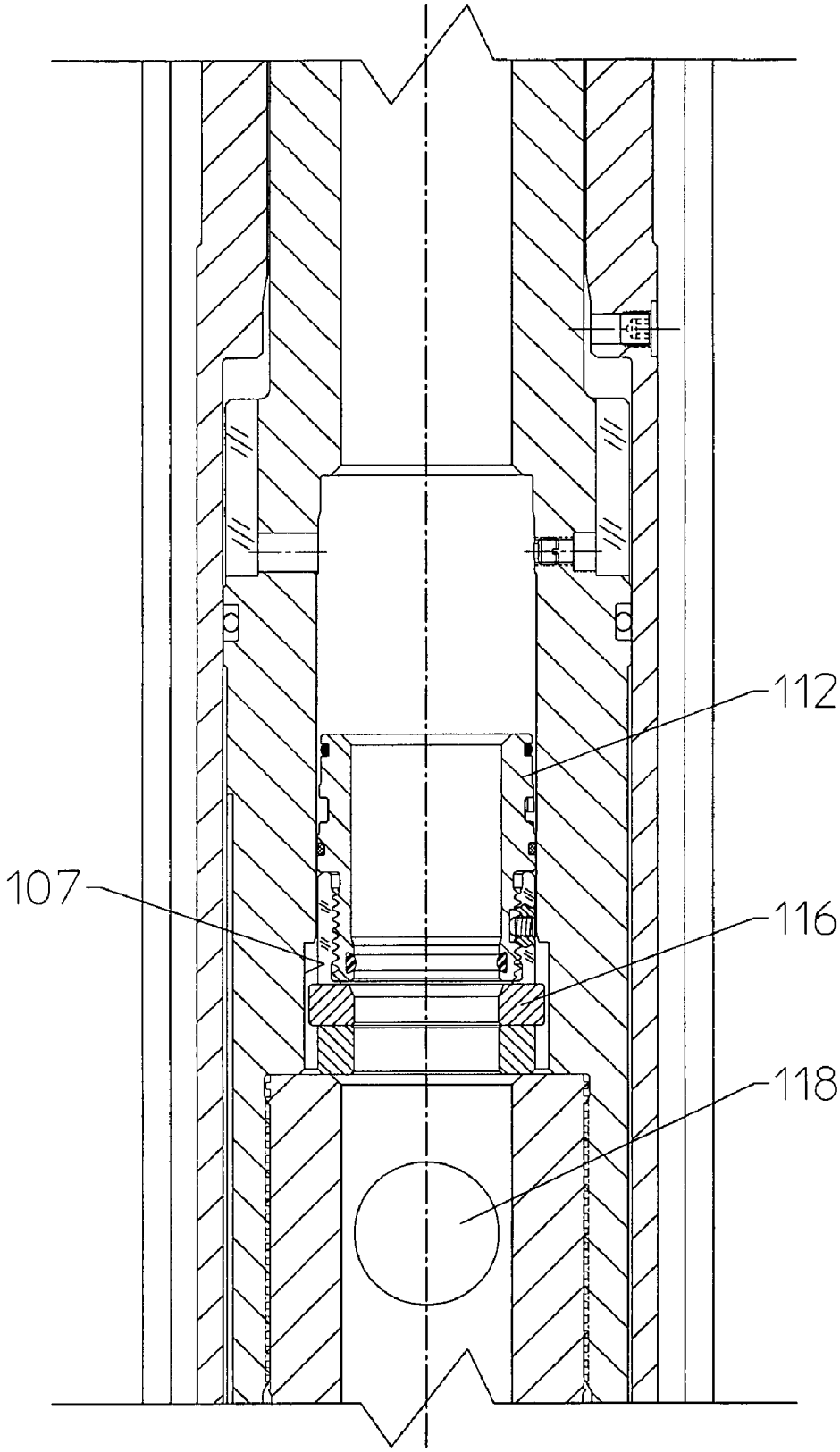
FIG. 4 shows the C-ring seat shifted downward, allowing the C-ring to expand and release the ball.

Once the ball has landed on the C-ring 116, it is sealed with the upper sleeve portion 112 by seal 117. The operator may then increase fluid pressure in the bore above the seated ball, until the shear pin 114 releases the subassembly to move in a manner of a piston until the lower end of the body engages the stop shoulder 108, as shown in FIG. 1B. When in this position, the C-ring 116, which had been retained in its compressed position by the inner surface of the mandrel which acts as a C-ring retainer, is released to a lower expanded position when entering the larger diameter bore 107 above the stop surface 108. Releasing the C-ring 116 to its normally relaxed and expanded position thus allows the ball to drop through the C-ring. FIG. 4 shows the subassembly in the lower position wherein the C-ring has been expanded to release the ball.

The C-ring 116 as shown in FIG. 2 has a plurality of radially outward projections 119 that each pass through circumferentially spaced slots 117 in the lower sleeve portion 111. The outer surface of the projections 119 engage the inner wall of the mandrel 104 to retain the C-ring in its compressed position prior to shearing the pins 114. To maintain proper alignment of the C-ring within the bore of the mandrel, the C-ring may be split at the location of one of these projections 119, so that each end of the C-ring, as well as intermediate portions between these ends, has a projection to engage the bore of the mandrel.

Figure 3A:
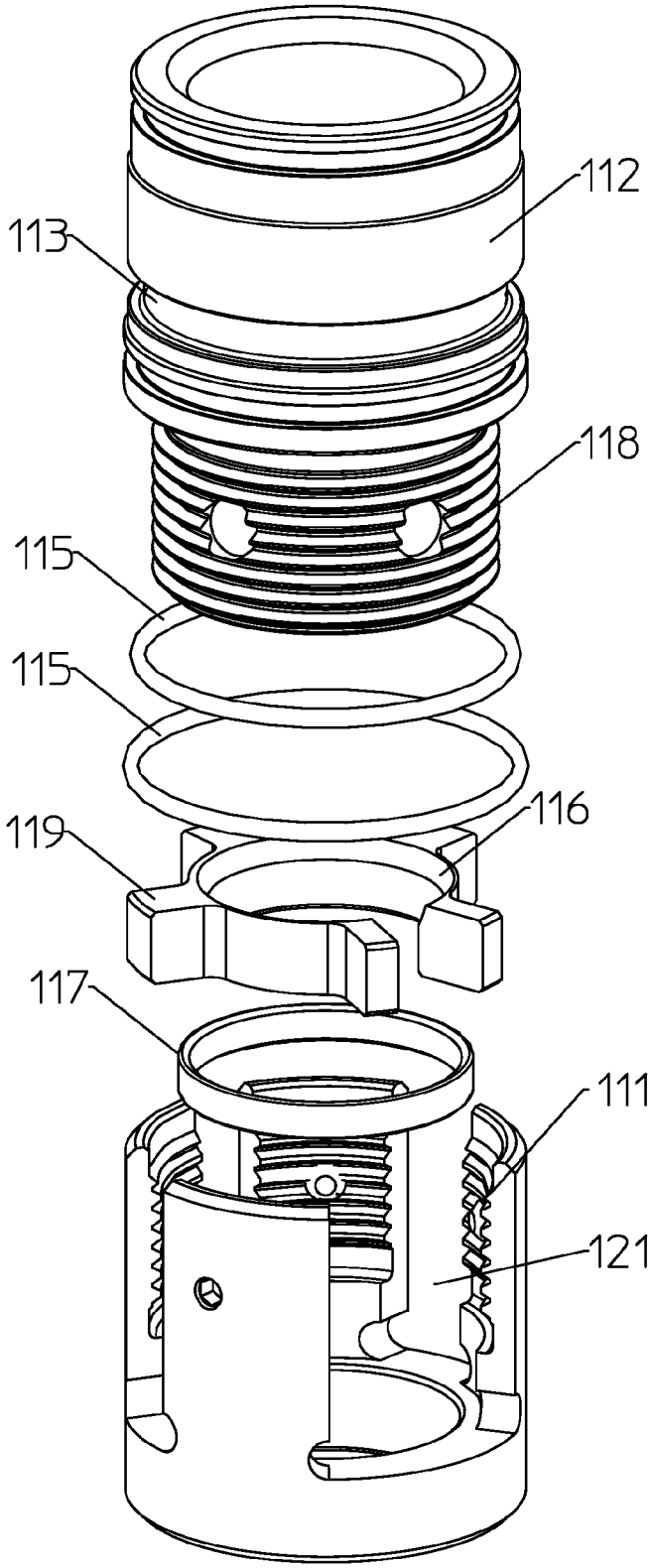
FIG. 3A is an exploded pictorial view of the c-ring seat subassembly shown in FIG. 3.

FIG. 3 is a cross-sectional view of the C-ring seat subassembly shown in FIGS. 1 and 2. FIG. 3A is an exploded view and more clearly depicts how the upper sleeve portion 112 may be threaded to the lower sleeve portion 111, with the C-ring 116 having radially outwardly projecting tabs 119 which each fit within a respective slot 121 in lower body portion 111.

A significant advantage of the C-ring seat mechanisms as shown in FIGS. 1B and 1D is that any desired fluid pressure, e.g., from several hundred to several thousand psi, may be used to reliably perform one or more tool operations, e.g., releasing the slips for setting, or releasing the set liner hanger from the running tool. In many cases, high fluid pressures are desired for some tool operations to increase their effectiveness, or to ensure activation at pressures above other tool operation activation pressures. Once these operations are complete, a relatively low fluid pressure may be used to pass the ball through the expanded C-ring seat. Since the ball release operation is performed at a low pressure, and optionally a pressure less than, and in many cases significantly less than, the one or more tool operation pressures, there is less likelihood of damaging the skin of one or more downhole formations during the ball releasing operation.

Figure 5:
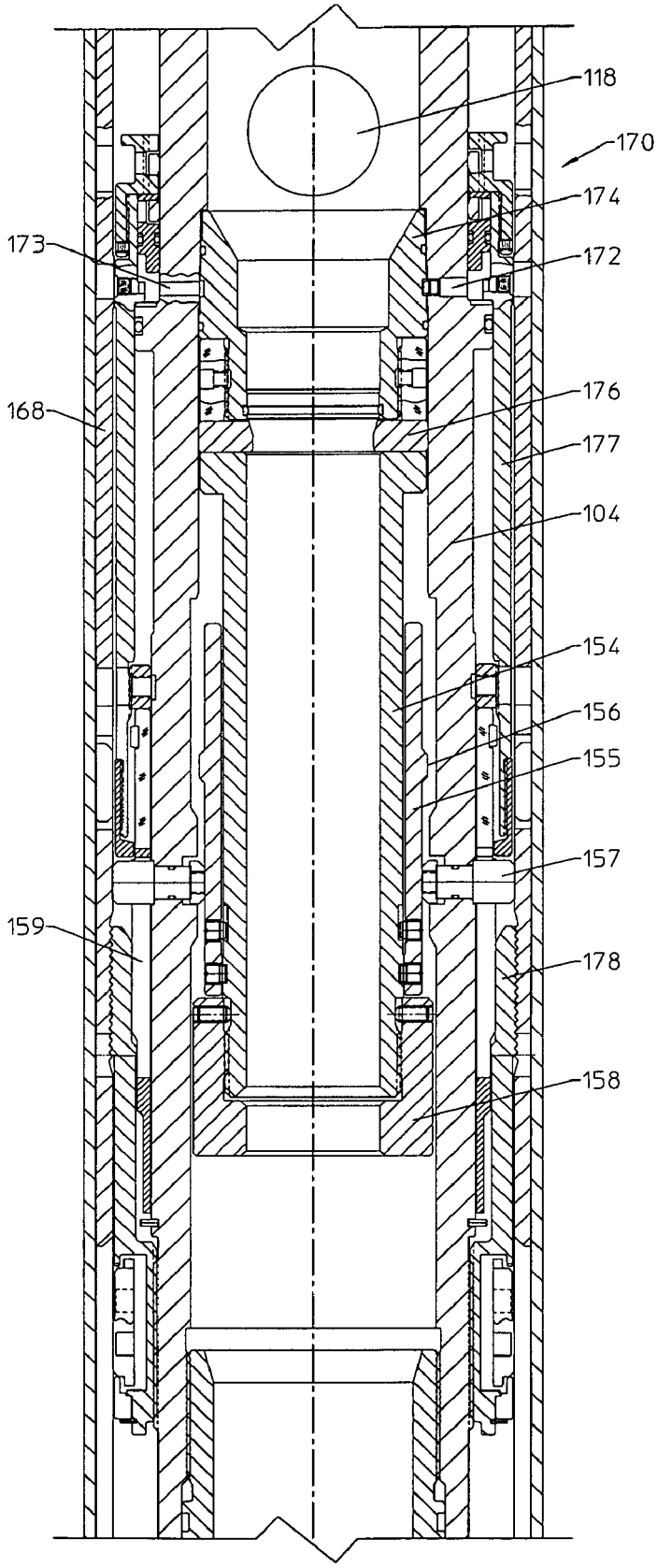
FIG. 5 shows another C-ring seat subassembly within the liner hanger assembly shown in FIG. 1D.

FIG. 5 shows in greater detail the C-ring seat 176 generally shown in FIG. 1D mounted within the bore of the running tool mandrel 104. The lower C-ring seat subassembly 170 serves as a tool actuator for releasing the tool from the set liner, as explained above. Sleeve 174 includes a pair of elastomeric seals similar to the seals 115 shown in FIG. 3. In this application, the sleeve 174 has an axially extended lower portion 154, with its lower end connected to end piece 158. A radially outer sleeve 155 includes an annular radially outward projection 156 thereon. A plurality of circumferentially spaced pins 157 are mounted in apertures provided in the mandrel 104, and are radially moving with respect thereto.

When in the upper position as shown in FIG. 5, the shear pins 172 maintain the entire subassembly in the upward position. Once the ball lands on the seat 176 and pressure increases above the seated ball, the increased fluid pressure will shear the pins 172, moving the subassembly downward to an intermediate position as shown in FIG. 6, wherein the circumferential projection 156 engage the pins 157, which act as stops to prevent further downward movement of the subassembly.

Figure 6:
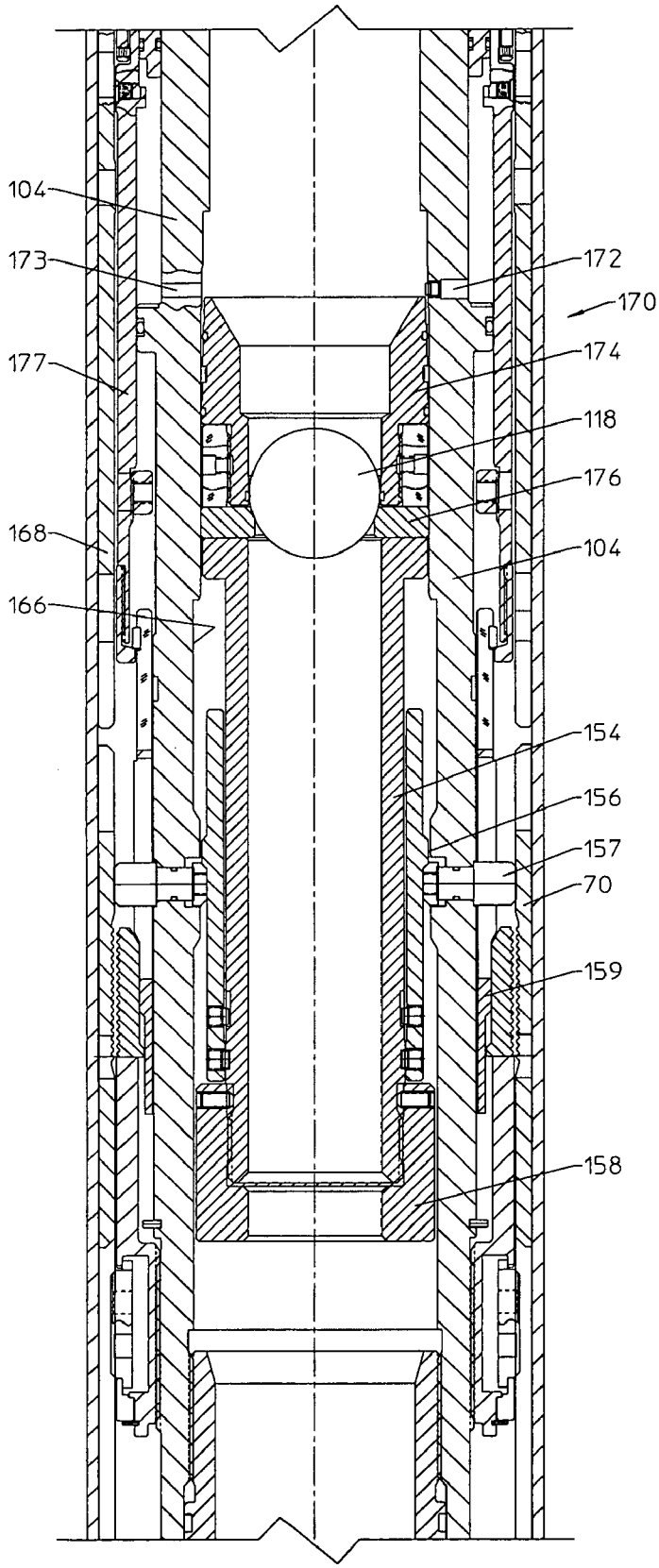
FIG. 6 illustrates a ball landed on the seat shown in FIG. 5, and the seat shifted downward to an intermediate position in response to fluid pressure above the ball.

With the sleeve shifted to the intermediate position as shown in FIG. 6, apertures 173 in the mandrel 104 adjacent the shear pins 172 allow fluid to flow radially outward of the mandrel 104, and to an operating piston 177. Once the tool is activated, piston 177 is raised, raising slotted retainer 159, which is connected to the lower end of piston 177. This allows the C-ring 178 to collapse radially inward to release the running tool from the set liner, and prior to setting the packer 122. The tool may then be lifted upward to ensure that it is disengaged from the set liner hanger.

Figure 7:
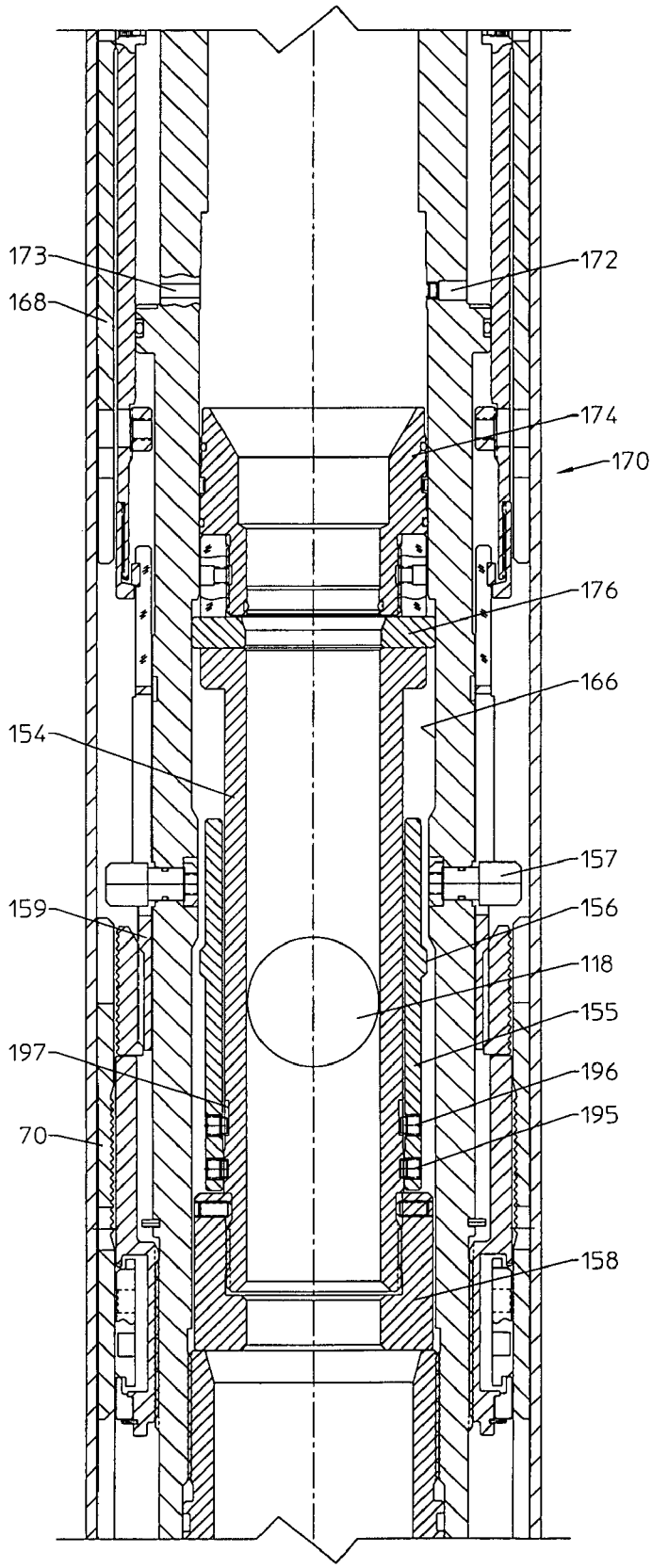
FIG. 7 illustrates a portion of the running tool shifted upward to remove a retainer which prevented the plurality of pins from moving radially outward, thereby lowering the C-ring to an expanded position to release the ball.

Assuming the function served by lifting piston 177 is the last tool function to be performed, the ball may be dislodged from the tool as follows. The I.D. of top of the liner hanger 70 acts as a retainer to hold the pins 157 radially inward in the FIG. 6 position. For this embodiment, the retainer is thus part of the liner hanger. The running tool and lower outer sleeve 168 are then pulled upward to a position to allow the pins 157 to be above and free of the retainer, so the pins can move out and release the ball sleeve 174, thereby resulting in the release of the ball. FIG. 7 shows lifting the entire tool upward with respect to the set liner hanger. The pins 157 will move radially outward and release the projections 156 to pass below the pins 157. This action also moves the C-ring 176 to a lower position within the enlarged diameter bore 166 in the mandrel 104, so that the C-ring 176 may be expanded to pass the ball by the C-ring, as shown in FIG. 7.

Various components other than pins may be used for moving radially outward and thereby releasing the closure seat to move within the enlarged diameter bore 166 and thus expand outward to release the ball. Radially movable lugs or buttons alternatively could be used, or this function may be served by a C-ring. A portion of the liner hanger 70 may thus act as a retainer to hold the pins 157 radially inward, as shown in FIG. 6, so that the running tool may be pulled upward to raise the pins above the upper end of the liner hanger. Other embodiments of a suitable retainer may include slots or windows to allow the pins to move radially outward. Also, this axial movement between the pins and the retainer may be accomplished at the surface by either raising or lowering the running tool. For other applications, a downhole actuator may be provided, such as a hydraulic actuator, to controllably stroke one component axially relative to another to allow the pins to move radially outward. The axial movement of the pins 157 relative to the retainer thus allows the closure seat to release the ball.

Figure 8:
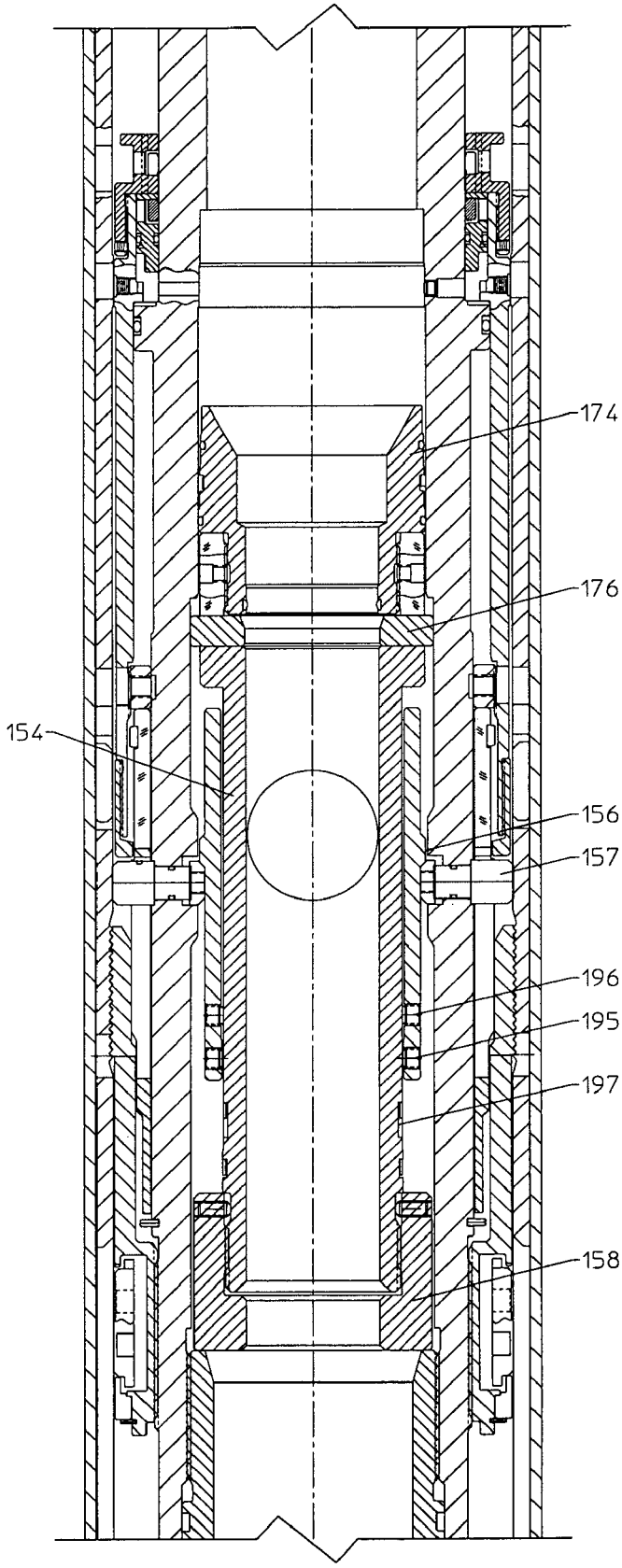
FIG. 8 discloses an alternate technique for releasing the ball from the ball seat.

FIG. 8 discloses an alternative mechanism that will allow for the discharge of the ball from the running tool to regain circulation in the event that the operator cannot release the running tool from the liner hanger. If the running tool release mechanism does not function, the FIG. 8 mechanism allows the ball to be discharged by increasing fluid pressure above the set ball to shear pins 195 and 196, thereby releasing the sleeve 174 to move downward and discharge the ball as the C-ring expands into larger bore 166. The tool and the liner hanger may then be retrieved from the well.

The FIG. 8 operating mechanism also allows tool operation if the pins 157 are prevented from moving radially outward. For example, debris in various passageways in the running tool could prevent the pins from moving outward. In this case, an alternative operating mechanism for releasing the ball from the seat 176 includes the use of a shear member, such as pins 195 and 196 as shown in FIG. 7, which interconnect the lower portion 154 of the sleeve 174 and the sleeve 155 radially outward of sleeve 154. As shown in FIG. 8, an increase in fluid pressure above the set ball causes the pins 195 and 196 to shear, dropping the sleeve 154, and allowing the C-ring 176 to expand into the larger diameter cavity.

In order to reduce the likelihood of a ball discharged by an upper seat assembly will land on and inadvertently pass through a lower seat assembly, the lower seat assembly may include two or more sets of axially spaced shear pins 195, 196 between the seat sleeve 154 and the sleeve 155 with the radially outward projection 156. The lower shear pins 195 may each be tightly positioned within a hole provided in the sleeve 174, while the upper shear pins 196 are positioned within a vertical slot 197 within the same sleeve. A ball landed on the seat 176 while positioned as shown in FIG. 6 may first cause shearing of the lower shear pins 195. Limited downward movement of the sleeve 174 relative to sleeve 155 may occur until the upper shear pins hit the upper end of the respective slot 197. Due to the energy absorbed by shearing the lower shear pins, the upper shear pins are not sheared when the lower pins are sheared, which prevents the tool from improperly actuating or passing the ball through the lower seat. The upper shear pins may have substantially the same pressure rating as the lower shear pins, and will shear at the desired pressure level.

While in the FIG. 6 position, fluid pressure may thus be increased above the seated ball so that the pins 195, 196 shear, thereby releasing the ring 176 and sleeve 174 to move downward relative to sleeve 155 and mandrel 104. This then allows the subassembly to drop to its lowest position as shown in FIG. 8, so that the ball is released from the seat 176.

Those skilled in the art should appreciate that the upper C-ring seat subassembly 110 as shown in FIG. 1B may be used in a liner hanger running tool to set the slips, and that the lower C-ring seat subassembly as shown in FIG. 1D may be used to release the running tool from the set liner hanger, with both C-ring assemblies cooperating with a single ball. In one alternative embodiment, the upper C-ring seat assembly alone, or only the lower C-ring subassembly alone, may be used to operate the liner hanger tool, either because the slips are otherwise set or the assembly is otherwise released from the liner hanger, or because a single C-ring ball seat subassembly may be used to both set the slips and thereafter release the tool from the set liner. In the former case, the slips may be set by an alternative mechanism which does not utilize increased pressure in the bore of the tool to actuate the tool, and the C-ring seat subassembly may be used to release the running tool from the set assembly. In another alternative, the running tool may be released from the set liner hanger by a mechanism that does not involve an increase in fluid pressure in the tool, and thus the C-ring seat subassembly may be used to only set slips. In a second alternative embodiment, both operations may be performed by the same C-ring seat subassembly. A wide range of fluid pressures are thus available to safely and reliably perform different operations at different fluid pressures. A single mechanism may be provided since relatively low pressures may be used to set the slips and then reliably move the C-ring to a position where it may expand within the running tool mandrel and thereby release the ball. For example, a fluid pressure of 1000 psi may be used to set the slips, while a fluid pressure of 2000 psi may be used to release the running tool from the set liner hanger then release the ball. Two or more piston may thus be actuated to perform the desired operations on the tool, and different fluid pressure levels and porting to the different pistons may be used to perform dual or multiple operations with a tool. Providing a comparatively low ball releasing pressure reduces the likelihood of high formation pressure damaging the skin of the formation, thereby enhancing hydrocarbon recovery.

Although a suitable location for the upper C-ring seat subassembly and the lower C-ring seat subassembly are shown in FIG. 1, the subassemblies may be positioned differently in another liner hanger running tool, including one with primary components of the assembly. If a single C-ring seat subassembly is used in a liner hanger, the assembly may be positioned for porting to two different pistons which actuate the tool, e.g., the slip setting assembly and the liner hanger releasing assembly. The C-ring seat subassembly may be positioned at any location in the tool which provides a central bore through the tool and porting to the pistons.

In other applications, the C-ring seat subassembly may be used for performing downhole operations other than those involving a liner hanger, including tools involved in packer setting operations or multilateral operations, tubing/casing hanger running tools, subsea disconnect tools, downhole surge valves, ball releasing subs, hydraulic disconnect tools, and various types of downhole setting tools. In each of these applications, the tool may be reliably operated at relatively low pressures to release the ball or other closure compared to prior art tools due to the use of the C-ring seat mechanism.

In the above discussion, the closure member which is used to seat with the C-ring seat mechanism and thereby increase fluid pressure is discussed as a ball, which is commonly used for this purpose in various applications. In other applications, other types of closure members may be used for seating with the C-ring assembly and reliably sealing with the seal above the C-ring. Darts, plugs, and other closure members may thus be used for this purpose. The tools disclosed herein are relatively simple, particularly with respect to the components which seat with the ball and subsequently release the ball from the seating surface, thereby providing high reliability and lower costs compared to prior art tools.

A C-ring closure seat is shown in the drawings for seating with the ball or other closure. In other embodiments, multiple dogs, lugs, pins or buttons could be used to form the closure seat. Each of these components could then move radially outward to release the ball when positioned within a large diameter bore of the tool. Also, a dog, lug, pin or button may move radially outward into the slot or groove provided in the tool body, in which case there may be no change in the diameter of the bore in the tool when the closure seat moves from a retaining position to a releasing position.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A downhole tool including a closure seat for receiving a closure and thereby increasing fluid pressure above the closure seat to perform an operation on the downhole tool and/or another downhole tool, comprising:

a tool body having a central throughbore for passing the closure through the tool body, the closure seat having a radially retracted and inward compressed position when positioned within the tool body for seating with the closure while the central throughbore restricts radial expansion of the closure seat;

a connector for temporarily limiting axial movement of the closure seat with respect to the tool body, and releasing the closure seat to move axially to a radially expanded position within the tool body to release the closure seat from the central throughbore and allow the closure seat to expand to an unbiased position and release the closure; and a seal body positioned for sealing with the closure; and an annular seal supported in an annular groove in the seal body above the closure seat for sealing between the closure and the seal body while the closure is seated on the closure seat.

2. The downhole tool as defined in claim 1, further comprising:

the seal body having an external seal for sealing with the throughbore in the down hole tool.

3. The downhole tool as defined in claim 1, wherein the connector comprises one or more shear pins.

4. The downhole tool as defined in claim 1, wherein the tool body includes an actuation port for passing fluid from above the seated closure to operate the tool and/or the another downhole tool.

5. The downhole tool as defined in claim 1, wherein the closure seat includes a plurality of radially outward extending tabs for engaging a wall of the central throughbore in the tool body when the closure is in its initial position.

6. The downhole tool as defined in claim 1, wherein the connector releases the closure seat for axial movement relative to the tool body, and a stop limits further downward movement of the released closure seat.

7. The downhole tool as defined in claim 6, wherein the stop moves radially outward to allow for further downward movement of the closure seat.

8. The downhole tool as defined in claim 6, wherein the stop limits downward movement of the seated closure when the closure is in the releasing position within the tool body.

9. The downhole tool as defined in claim 1, further comprising:

one or more safety connectors for limiting axial movement of the closure seat with respect to the tool body after the closure seat has disengaged from its radially retracted position, and thereafter permitting further downward movement of the closure seat to release the closure.

10. The downhole tool as defined in claim 1, wherein the tool body has a plurality of closure seats which sequentially operate the downhole tool and/or another downhole tool.

11. A downhole tool including a closure seat for receiving a closure and thereby increasing fluid pressure above the closure seat to perform an operation on the downhole tool and/or another downhole tool, comprising:

a tool body having a central throughbore for passing the closure through the tool body, a portion of the central throughbore having a restricted diameter;

a closure seat having a radially retracted position when positioned within the restricted diameter portion of the tool body for seating with the closure while the restricted diameter portion of the central throughbore restricts radial expansion of the closure seat, the closure seat including a plurality of radially outward extending tabs for engaging a wall of the restricted diameter portion of the central throughbore in the tool body when the closure is in its initial position;

a seal body having an external seal for sealing with the throughbore in the down hole tool;

an annular seal supported in an annular groove in the seal body for sealing with the closure while seated on the closure seat; and a connector for temporarily limiting axial movement of the closure seat with respect to the tool body, and releasing the closure seat to move axially to a radially expanded position for allowing expansion of the closure seat and release the closure.

12. The downhole tool as defined in claim 11, wherein the tool body includes an actuation port for passing fluid from above the seated closure to operate the tool and/or the another downhole tool.

13. The downhole tool as defined in claim 11, wherein the seal body includes circumferentially spaced slot seats for receiving a radial projection of the closure seat, such a radially outward surface of each projection engages a wall of the central throughbore to retain the closure seat in the compressed position.

14. The downhole tool as defined in claim 13, wherein the circumferentially spaced slots in the seal body limit axial movement of a closure seat with respect to the seal body in both an upward direction and a downward direction.

15. A method of operating a downhole tool including a closure seat for receiving a closure and thereby increasing fluid pressure above the closure seat to perform an operation on the downhole tool and/or another downhole tool, comprising:

providing a tool body with a central throughbore for passing the closure through the tool body;

providing a closure seat within the tool body having a radially retracted and inward position for seating with the closure while in a restricting portion of the central throughbore;

providing a seal body for supporting the closure seat, the seal body including circumferentially spaced slots for receiving a radial projection of the closure seat, such a radially outward surface of each projection engages a wall of the central throughbore to retain the closure seat in the compressed position;

temporarily limiting axial movement of the closure seat; and releasing the closure seat to move axially within the tool body such that the closure seat is in a radially expanded and unbiased position while within a releasing portion of the tool body to allow expansion of the closure seat to release the closure.

16. The method as defined in claim 15, further comprising:

positioning the seal body above the closure seat; and providing an annular seal supported on the seal body for sealing between the closure and the seal body while the closure is seated on the closure seat.

17. The method as defined in claim 15, further comprising:

a seal body having an external seal for sealing with the central throughbore in the downhole tool.

18. The method as defined in claim 15, wherein the tool body includes an actuation port for passing fluid from above the seated closure to operate the tool and/or the another downhole tool.

19. A downhole tool for performing a downhole operation with a downhole device having a retainer, the downhole tool comprising:

a tool body having a central throughbore for passing a closure through the tool body;

a closure seat having a radially retracted position when positioned within the tool body for seating with the closure while the central throughbore restricts radial expansion of the closure seat;

a seal body having an external seal for sealing with the throughbore in the down hole tool;

a connector initially limiting axial movement of the closure seat with respect to the tool body when held in an initial position by the retainer, and when moved out of engagement with the retainer, releasing the closure seat to move axially with respect to the tool body to a radially expanded position for releasing position when the closure seat moves radially outward to an expanded position and releases the closure; and the seal body including circumferentially spaced slots each for receiving a radial projection on the closure seat, such that a radially outward surface of each projection engages a wall of the central throughbore to retain the closure seat in the radially retracted position.

20. The downhole tool as defined in claim 19, wherein the tool body includes an actuation port for passing fluid from above the seated closure to operate the tool and/or the another downhole tool.

21. The downhole tool as defined in claim 19, wherein the tool body has a plurality of closure seats which sequentially operate the downhole tool and/or another downhole tool.

22. A method of using a downhole tool including a closure seat for receiving a closure and thereby increasing fluid pressure above the closure seat to perform an operation on the downhole tool or another downhole tool having a retainer, the method comprising:

providing a tool body having a central throughbore for passing the closure through the tool body;

initially positioning a radially outward biased closure seat within the tool body in a radially retracted and inward compressed position for seating with the closure while the central throughbore restricts radial expansion of the closure seat;

positioning a seal body for sealing with the closure while on the closure seat;

supporting an annular seal in an annular groove in the seal body above the closure seat for sealing between the closure and the seal body while the closure is seated on the closure seat; and initially limiting axial movement of the closure seat with respect to the tool body when the closure seat is held in an initial position by the retainer, and when moved out of engagement with the retainer, releasing the closure seat to move axially with respect to the tool body and to a radially expanded position within the tool body in response to its radially outward bias such that the closure seat moves radially outward to the radially expanded position and releases the closure.

23. The method as defined in claim 22, wherein the tool body includes an actuation port for passing fluid from above the seated closure to operate the tool and/or the another downhole tool.

24. The method as defined in claim 22, wherein the closure seat includes a plurality of radially outward extending tabs for engaging a wall of the central throughbore in the tool body when the closure is in its initial position.

* * * * *